United States Patent [19]

Winberg

[11] Patent Number: 4,781,021

[45] Date of Patent: Nov. 1, 1988

[54] MARINE ENGINE EXHAUST MUFFLER ASSEMBLY

[75] Inventor: Arvid E. Winberg, Fond du Lac, Wis.

[73] Assignee: Brunswick Corporation, Skokie, Ill.

[21] Appl. No.: 55,691

[22] Filed: May 29, 1987

[51] Int. Cl.[4] ..... F01N 3/02

[52] U.S. Cl. ..... 60/309; 55/276; 55/509; 60/310; 440/89

[58] Field of Search ..... 60/309, 310, 311; 440/89; 181/260, 261, 264, 267, 269; 55/276, 509

[56] References Cited

U.S. PATENT DOCUMENTS

| | | | |
|---|---|---|---|
| 1,821,688 | 9/1931 | Bourne | 181/264 |
| 3,449,086 | 6/1969 | Innes | 60/299 |
| 3,712,031 | 1/1973 | Santa Cruz | 60/310 |

FOREIGN PATENT DOCUMENTS

| | | | |
|---|---|---|---|
| 2164771 | 7/1972 | Fed. Rep. of Germany | 60/309 |
| 12546 | 7/1910 | France | 181/267 |

*Primary Examiner*—Douglas Hart

*Attorney, Agent, or Firm*—Andrus, Sceales, Starke & Sawall

[57] ABSTRACT

A marine engine exhaust muffler assembly (8) includes inlet and outlet members (10, 11), the axes (13, 14) of which are offset from each other. A muffler housing (12) is disposed between the inlet and outlet members and forms a chamber (15) having disposed therein an annular multi-layered cartridge (23), and with the layers having a multiplicity of perforations (27) therein for passage of exhaust gases and spent engine cooling water therethrough. The water assists in keeping the muffler clean. An imperforate arcuate blocking plate (31) is nested within the lower portion of the cartridge to permit accumulation of the spent engine cooling water within the cartridge to aid in noise reduction at certain engine speeds. The blocking plate is provided with a relief opening means (33) for assisting in water drainage upon engine shutoff.

14 Claims, 2 Drawing Sheets

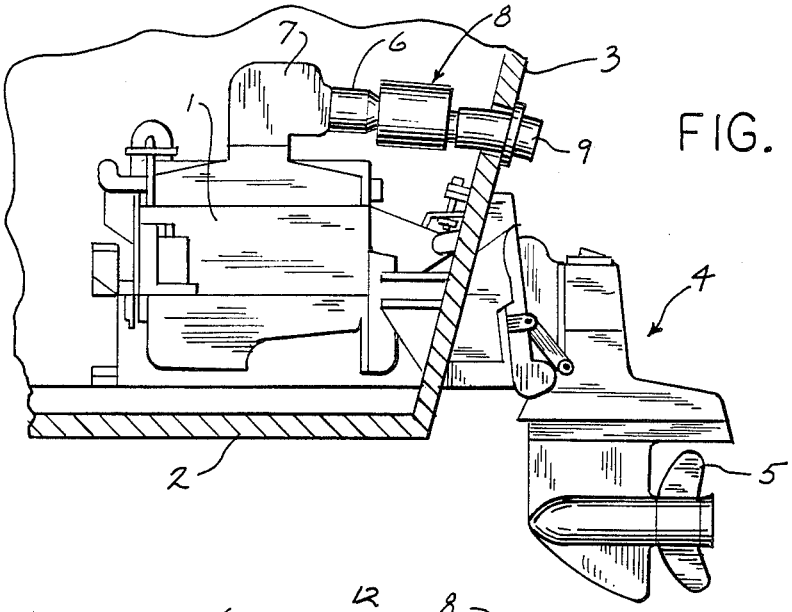
FIG. 1
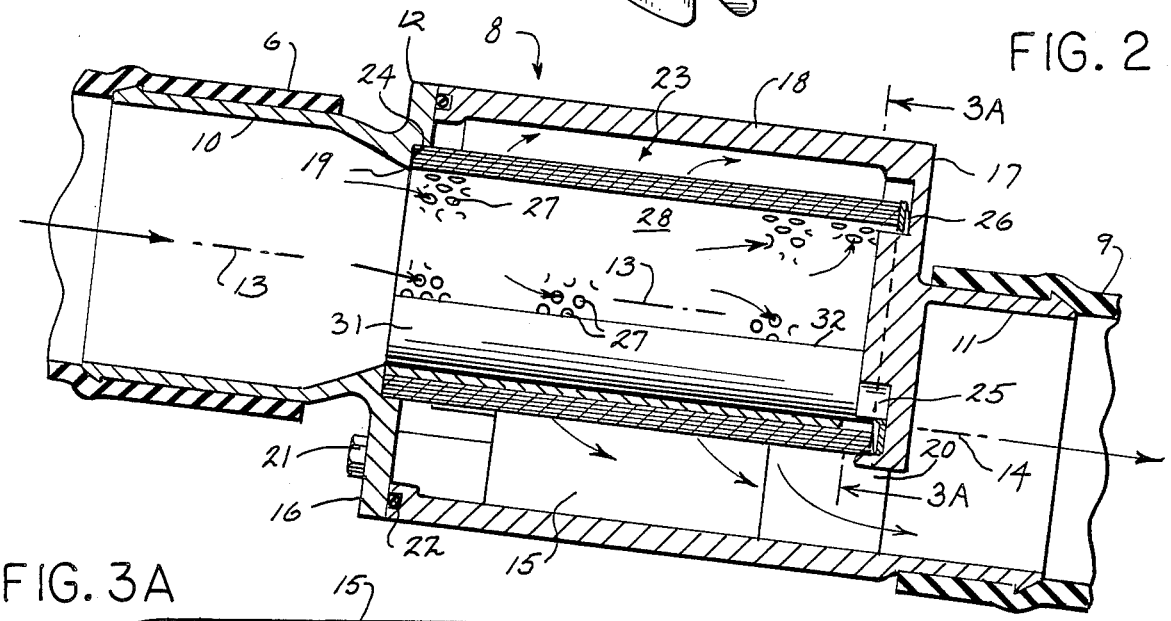
FIG. 2
FIG. 3A
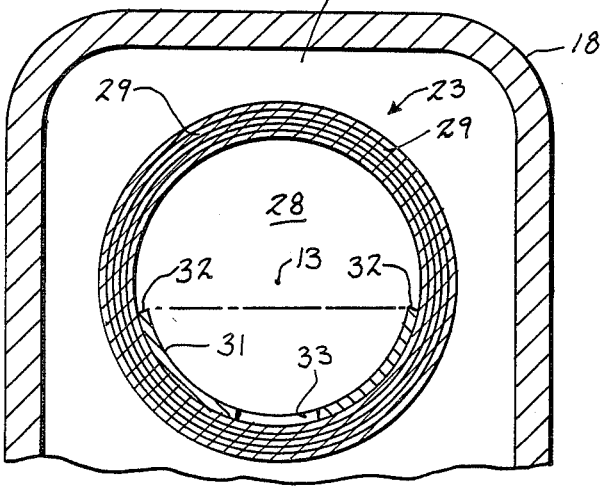
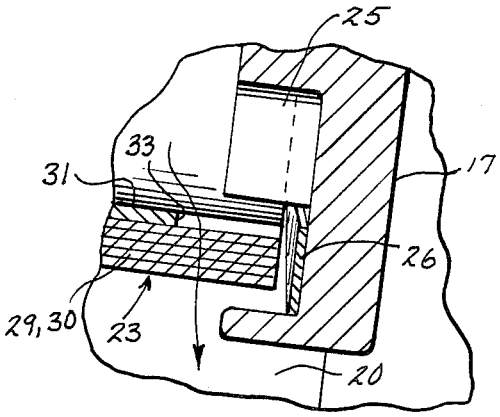
FIG. 4

MARINE ENGINE EXHAUST MUFFLER ASSEMBLY

BACKGROUND AND SUMMARY OF THE INVENTION

This invention relates to a marine engine exhaust muffler assembly and more particularly to a muffler for use in association with an inboard marine engine.

Over the years, stern drive engines have become more and more powerful, with an accompanying increase in noise levels due to exhaust discharge and flow noise. Such noise needs to be reduced as much as possible, both for the comfort of the user and also to accommodate restrictions on overall noise levels imposed by various environmental pollution control agencies.

It is an object of the present invention to provide a marine engine exhaust muffler which effectively reduces related noise levels and which is relatively simple in construction and economical to manufacture. It is a further object to provide a muffler which can easily be retrofit to most stern drive marine engine systems.

In accordance with the various aspects of the invention, a muffler assembly includes inlet and outlet members, the axes of which are offset from each other. A muffler housing is disposed between the inlet and outlet members and forms a chamber having disposed therein an annular multi-layered cartridge, and with the layers having a multiplicity of perforations therein for passage of exhaust gases and spent engine cooling water therethrough. The water assists in keeping the muffler clean. An imperforate arcuate blocking plate is nested within the lower portion of the cartridge to permit accumulation of the spent engine cooling water within the cartridge to aid in noise reduction at certain engine speeds. The blocking plate is provided with a relief opening means for assisting in water drainage upon engine shutoff.

BRIEF DESCRIPTION OF THE DRAWINGS

The accompanying drawings illustrate the best mode presently contemplated by the inventor for carrying out the invention.

In the drawings:

FIG. 1 is a schematic side elevation of a marine stern drive system which incorporates the muffler of the present invention;

FIG. 2 is an enlarged longitudinal section of the muffler;

FIG. 3A is a transverse section taken on line 3A—3A of FIG. 2 and showing one form of cartridge with its associated blocking plate;

FIG. 4 is an enlarged fragmentary view of the downstream lower corner of the muffler housing and showing the cooling water relief outlet.

DESCRIPTION OF THE PREFERRED EMBODIMENT

Figure 3B:
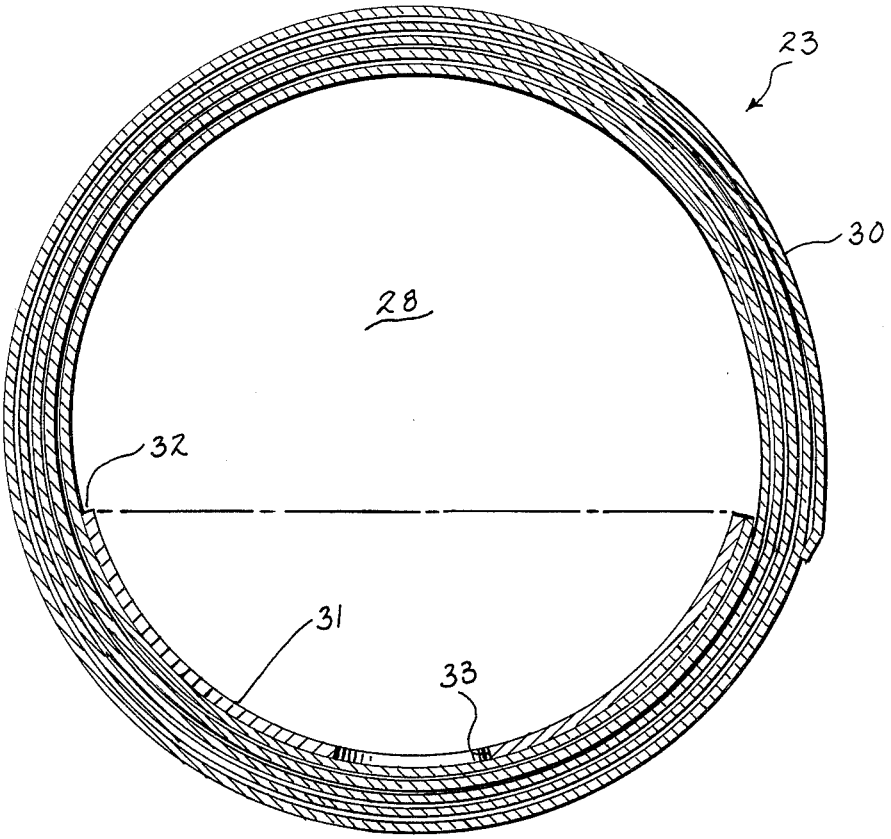
FIG. 3B is a sectional view similar to FIG. 3A and showing another form of cartridge.

As shown in the drawings, the various aspects of the invention are to be utilized in connection with a stern drive marine internal combustion engine 1 mounted within a boat 2 and adjacent the rear transom 3 thereof. Engine 1 is adapted to propel boat 2 through the water via the usual stern drive unit 4 having a propeller 5 or the like. The engine has the usual cooling water system and exhaust manifold (not shown), and is adapted to discharge the cooling water and exhaust gases rearwardly through the discharge pipe 6 of an exhaust elbow 7 of any suitable well-known type. A muffler assembly 8 is connected between exhaust elbow 7 and a tubular fitting 9 which extends rearwardly through transom 3 for final gas and water discharge outside boat 2.

Muffler assembly 8 generally includes an inlet pipe 10 adapted to be suitably connected to exhaust elbow discharge pipe 6, an outlet pipe 11 adapted to be suitably connected to fitting 9, and a longitudinally extending muffler housing 12 disposed therebetween. Pipes 10 and 11 are shown as offset from each other, with the axis 13 of pipe 10 being disposed generally parallel to and at a level transversely above the axis 14 of pipe 11.

Muffler housing 12 forms an inner muffler chamber 15 defined by a transverse upstream end wall 16, a transverse downstream end wall 17 and a longitudinally extending intermediate generally rectangular wall 18. These walls are contemplated as being formed of heavy gauge metal for purposes of rigidity and silencing. Upstream end wall 16 is disposed at the inner terminus of inlet pipe 10 and is provided with a suitable opening 19 providing communication between pipe 10 and chamber 15. Downstream end wall 17 is disposed at the inner terminus of outlet pipe 11 and is provided with a suitable opening 20 at its lower end for communication between pipe 11 and chamber 15. For ease of assembly and access, pipe 11 and downstream end wall 17 and intermediate wall 18 may be integrally formed into a sub-assembly which is attachable to upstream end wall 16 in any suitable manner, such as by bolts 21. A suitable sealing member 22 is shown as disposed between wall 16 and the edge of wall 18.

A generally cylindrical muffler cartridge 23 is disposed in the upper portion of muffler chamber 15 and is contemplated as being aligned coaxially with pipe 10 on common axis 13. The upstream end of cartridge 23 is received within an annular shoulder 24 formed in the interior face of upstream end wall 16. The downstream end of cartridge 23 is received within an annular groove 25 formed in the interior face of downstream end wall 17. An annular undulating leaf spring washer 26 is confined between the downstream edge of cartridge 23 and the base of groove 25 so that cartridge 23 is biased upstream against shoulder 24 and against the flow of gases and cooling water.

Muffler cartridge 23 comprises a multilayered cylindrical body, preferably of stainless steel, which has a multiplicity of perforations such as holes 27 scattered throughout in such a manner as to permit fluid communication between the inside and outside thereof. A muffler chamber 28 having concave internal walls is thereby formed. Chamber 28 is closed at its downstream end by end wall 17. In the embodiment shown in FIG. 3A, the body of cartridge 23 is formed of a plurality of separate concentrically disposed cylinders 29. FIG. 3B illustrates another embodiment wherein the body of cartridge 23 is formed of a single spirally wound sheet 30, the ends of which are suitably secured to the body, as by tack welding, to hold it together.

During operation of engine 1, spent cooling water and exhaust gases enter muffler assembly 8 through inlet pipe 10 and pass into the interior of cartridge 23 and thus chamber 28. These fluids are then forced through the body of cartridge 23, via holes 27, and pass outwardly into housing chamber 15 and downwardly therein by gravity and hence through lower downstream opening 20 to fitting 9 for ultimate discharge. The construction is such that the flowing water assists in cleaning the cartridge, and the water and exhaust gases are thoroughly mixed.

To aid in the noise reduction provided by cartridge 23, a generally imperforate arcuate longitudinal blocking plate 31 is disposed in the interior thereof in chamber 28. Plate 31 nests in the bottom of chamber 28 and causes a buildup of some of the water within the muffler so that the water cannot flow through part of the cartridge body. This has been found to assist in noise reduction at engine idle. Furthermore, the upper longitudinal edges 32 of blocking plate 31 are disposed beneath axis 13 and form dams for water overflow if needed.

Means are provided to allow water accumulated above blocking plate 31 to drain out when engine 1 is turned off. For this purpose, the bottom of the downstream end portion of plate 31 is provided with a relief hole 33 which communicates through the area of spring washer 26 within groove 25 at the end of cartridge 23 and hence to opening 20, as shown by the arrow in FIG. 4.

Various modes of carrying out the invention are contemplated as being within the scope of the following claims particularly pointing out and distinctly claiming the subject matter which is regarded as to the invention.

I claim:

1. For use in association with a marine engine (1) having means (6) for discharge of exhaust gases and spent engine cooling water, a muffler assembly (8) comprising, in combination:

(a) a gas-water inlet member (10) adapted to be connected to the discharge means of the engine, (b) a gas-water outlet member (11) disposed downstream of said inlet member, (c) a longitudinally extending muffler housing (12) disposed between said inlet and outlet members and with said housing forming a first chamber (15) in communication with said members, (d) a muffler cartridge (23) disposed in said first chamber and with said cartridge forming a second chamber (28) therein, (e) said cartridge including a body having perforation means (27) therein so that exhaust gases and spent engine cooling water are mixed and flow from said second chamber and outwardly through said perforation means into said first chamber, (f) and means (31) for accumulating spent engine cooling water within said cartridge during engine operation.

2. The combination of claim 1 in which said cooling water accumulating means includes a generally imperforate blocking member (31) disposed within said second chamber (28) for preventing flow of spent cooling water outwardly through a portion of said perforation means (27) in said body of said cartridge (23).

3. The combination of claim 2 in which:

(a) said cartridge (23) is generally cylindrical, (b) and said blocking member 31 comprises an arcuate plate nested in the bottom of said second chamber (28).

4. The combination of claim 1, 2 or 3 in which said inlet member (10) and said outlet member (11) extend longitudinally and define respective generally parallel axes (13, 14) which are offset transversely from each other.

5. The combination of claim 3 in which:

(a) said inlet member (10) and said outlet member (11) extend longitudinally and define respective generally parallel axes (13, 14) which are offset transversely from each other, (b) said cartridge (23) is on a generally common axis (13) with said inlet member, (c) and said blocking member (31) has upper longitudinal edges (32) disposed below said common axis.

6. The combination of claim 2, 3 or 5 which includes relief opening means (33) disposed in said blocking member (31) for draining accumulated water from the latter upon engine shutoff.

7. The combination of claim 6:

(a) in which said muffler housing (12) includes a transverse downstream wall (17), (b) said downstream wall having a groove (25) therein which receives an end of said muffler cartridge (23) therein, (c) and biasing means (26) disposed in said groove to bias said cartridge upstream toward said inlet member (10), (d) said relief opening means (33) providing for water flow communication through said biasing means to said outlet member (11).

8. For use in association with a marine engine (1) having means (6) for discharge of exhaust gases and spent engine cooling water, a muffler assembly (8) comprising, in combination:

(a) a gas-water inlet member (10) adapted to be connected to the discharge means of the engine, (b) a gas-water outlet member (11) disposed downstream of said inlet member, (c) a longitudinally extending muffler housing (12) disposed between said inlet and outlet members and with said housing forming a first chamber (15) in communication with said members, said first chamber being defined by transverse upstream and downstream walls (16, 17) and a longitudinally extending intermediate wall (18), (d) means (21) for removably attaching said intermediate wall to said upstream wall (16), (e) means (22) for sealing said upstream wall to said intermediate wall, (f) a removable muffler cartridge (23) disposed in said first chamber and with said cartridge forming a second chamber (28) therein, (g) said cartridge including a body having perforation means (27) therein so that exhaust gases and spent engine cooling water are mixed and flow from said second chamber and outwardly through said perforation means into said first chamber, (h) said inlet member and said outlet member extending longitudinally and defining respective generally parallel axes (13, 14) which are offset transversely from each other.

9. The combination of claim 8:

(a) in which said cartridge (23) is on a generally common axis (13) with said inlet member (10), (b) said common axis being disposed at a level transversely above the axis (14) of said outlet member (11).

10. For use in association with a marine engine (1) having means (6) for discharge of exhaust gases and spent engine cooling water, a muffler assembly (8) comprising, in combination:

(a) a gas-water inlet member (10) adapted to be connected to the discharge means of the engine, (b) a gas-water outlet member (11) disposed downstream of said inlet member, (c) a longitudinally extending muffler housing (12) disposed between said inlet and outlet members and with said housing forming a first chamber (15) in communication with said members, (d) a muffler cartridge (23) disposed in said first chamber and with said cartridge forming a second chamber (28) therein, (e) said cartridge including a body having perforation means (27) therein so that exhaust gases and spent engine cooling water are mixed and flow from said second chamber and outwardly through said perforation means into said first chamber, (f) said muffler housing including a transverse downstream wall (17), (g) said downstream wall having a groove (25) therein which receives an end of said muffler cartridge therein, (h) and biasing means (26) disposed in said groove to bias said cartridge upstream toward said inlet member (10).

11. The combination of claim 1 or 10 in which the body of said muffler cartridge (23) is multilayered and comprises a plurality of concentric cylinders (29).

12. The combination of claim 1 or 10 in which the body of said muffler cartridge (23) is multilayered and comprises a spirally wound sheet (30).

13. For use in association with a marine engine (1) having means (6) for discharge of exhaust gases and spent engine cooling water, a muffler assembly (8) comprising, in combination:

(a) a gas-water inlet member (10) adapted to be connected to the discharge means of the engine, (b) a gas-water outlet member (11) disposed downstream of said inlet member, (c) a longitudinally extending muffler housing (12) disposed between said inlet and outlet members and with said housing forming a first chamber (15) in communication with said members, (d) a muffler cartridge (23) disposed in said first chamber and with said cartridge forming a second chamber (28) therein, (e) said cartridge including a body having perforation means (27) therein so that exhaust gases and spent engine cooling water are mixed and flow from said second chamber and outwardly through said perforation means into said first chamber, (f) said inlet member and said outlet member extending longitudinally and defining respective generally parallel axes (13, 14) which are offset transversely from each other, (g) the body of said muffler cartridge (23) being multilayered and comprising a plurality of concentric cylinders (29).

14. For use in association with a marine engine (1) having means (6) for discharge of exhaust gases and spent engine cooling water, a muffler assembly (8) comprising, in combination:

(a) a gas-water inlet member (10) adapted to be connected to the discharge means of the engine, (b) a gas-water outlet member (11) disposed downstream of said inlet member, (c) a longitudinally extending muffler housing (12) disposed between said inlet and outlet members and with said housing forming a first chamber (15) in communication with said members, (d) a muffler cartridge (23) disposed in said first chamber and with said cartridge forming a second chamber (28) therein, (e) said cartridge including a body having perforation means (27) therein so that exhaust gases and spent engine cooling water are mixed and flow from said second chamber and outwardly through said perforation means into said first chamber, (f) said inlet member and said outlet member extending longitudinally and defining respective generally parallel axes (13, 14) which are offset transversely from each other, (g) the body of said muffler cartridge (23) being multilayered and comprising a spirally wound sheet (30).

* * * * *